US009606484B1

(12) United States Patent
Jensen et al.

(10) Patent No.: US 9,606,484 B1
(45) Date of Patent: Mar. 28, 2017

(54) METHOD FOR TEMPERATURE LEVELING AND/OR RESISTANCE INCREASE IN SOLID HEATERS

(71) Applicant: XEROX CORPORATION, Norwalk, CT (US)

(72) Inventors: Christopher A Jensen, Portland, OR (US); Tab Alan Tress, Henrietta, NY (US); Brian Gillis, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/063,537

(22) Filed: Mar. 8, 2016

(51) Int. Cl.
*G03G 15/20* (2006.01)

(52) U.S. Cl.
CPC ..... *G03G 15/2053* (2013.01); *G03G 15/2082* (2013.01)

(58) Field of Classification Search
CPC ..... G03G 15/2053; G03G 15/2042; G03G 15/2082
USPC ..... 399/330, 333, 334; 219/216
See application file for complete search history.

(56) References Cited

U.S. PATENT DOCUMENTS

| | | | | |
|---|---|---|---|---|
| 5,171,969 | A | 12/1992 | Nishimura et al. | |
| 5,204,723 | A * | 4/1993 | Hanada | G03G 15/2042 219/216 |
| 6,353,718 | B1 | 3/2002 | Roxon et al. | |
| 6,423,941 | B1 | 7/2002 | Kanari et al. | |
| 6,580,883 | B2 | 6/2003 | Suzumi | |
| 7,193,180 | B2 | 3/2007 | Cook et al. | |
| 7,193,181 | B2 | 3/2007 | Makihira et al. | |
| 7,228,082 | B1 | 6/2007 | Davidson et al. | |
| 2012/0051807 | A1* | 3/2012 | Tress | G03G 15/2053 399/334 X |

* cited by examiner

*Primary Examiner* — Sophia S Chen

(57) ABSTRACT

An improved fuser includes a heater which provides uniformity at the surface of a fuser roll that contacts an imaged sheet. The heater is configured to include a common tap at the center of a single heating trace. This allows for the benefits of a single trace configuration well while simultaneously providing a dedicated common line that does not have to be switched around.

18 Claims, 6 Drawing Sheets

METHOD FOR TEMPERATURE LEVELING AND/OR RESISTANCE INCREASE IN SOLID HEATERS

BACKGROUND

1. Field of the Disclosure

This invention relates generally to electrostatographic reproduction machines, and more particularly, to a fuser adapted to handle multiple paper widths and is especially useful in center registered machines.

2. Description of Related Art

In electrostatographic printing, commonly known as xerographic or printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt and otherwise fuse the toner permanently on the substrate. In this way, durable, non-smudging images are rendered on the substrates.

The most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image. As shown in U.S. Pat. No. 7,193,180 B2, for example, a resistive heater is disclosed that is adapted for heating a fuser belt with the heater comprising a substrate, a first resistive trace formed over the substrate, and a second resistive trace formed so as to at least partially overlap the first trace.

Provisions can be made in fusers to take into account the fact that sheets of different sizes may be passed through the fusing apparatus, ranging from postcard-sized sheets to sheets which extend the full length of the rolls. Further, it is known to control the heating element or elements inside the fuser roll to take into account the fact that a sheet of a particular size is being fed through the nip. For example, in U.S. Pat. No. 6,353,718 B1 a fuser roll is shown with two parallel lamps or heating elements therein that in each case include a relatively long major portion of heating-producing material along with a number of smaller portions of heat-producing material with all being connected in series. Within each lamp, a major portion is disposed toward one particular end of the fuser roll, while the relatively smaller portions are disposed toward the opposite end of the fuser roll. This particular configuration of heating elements within each lamp will have a relatively hot and relatively cold end. That is, when electrical power is applied to either lamp, one end of the lamp will largely generate more heat that the other end of the lamp.

U.S. Pat. No. 7,228,082 B1 discloses printing machine that includes a fuser for fusing an image onto a sheet. The fuser includes an endless belt having a plurality of predefined sized fusing areas that are selectively activatable and the plurality of predefined sized fusing areas are arranged in a substantially parallel manner along a process direction of the belt. A means is included for activating one or more of the plurality of predefined sized fusing areas to correspond to one of the selected predefined sized sheets. Multi-tap series controlled ceramic heaters of this design have a flaw in that a conductor interface to the heat-producing materials creates a cold spot which reduces the heater temperature locally and creates a radial cold area in the fuser roll causing image quality issues.

Current center registered solid heaters either require multiple heating traces or a relay to switch between multiple taps on one trace as shown, for example, in U.S. Pat. Nos. 5,171,969; 6,423,941 B1; 6,580,883 and 7,193,181. Multiple heating traces have been shown to hurt heat transfer performance and thus extendibility since only one heating trace can be in optimal position for heat transfer. Configurations with inter heating trace conductive taps have cold spot that effect and hurt latitudes and require bigger drawer connections with extra pins. Current single heating traces with multiple tap designs require an extra drawer connector pin as compared to multiple trace designs and require either serial control or perfect knowledge of media widths.

BRIEF SUMMARY

In answer to the above-mentioned shortcomings of previous solid heaters, an improved fuser is disclosed that includes a center registered heater which provides uniformity at the surface of the fuser that contacts an imaged sheet by configuring the heater to include a single resistive heating trace with multiple taps for heating different media widths. A tap is placed right at the center of the heating trace. This line can then serve as a dedicated common when firing the different heating zones.

BRIEF DESCRIPTION OF THE DRAWINGS

The disclosed printer and fuser system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

Figure 1:
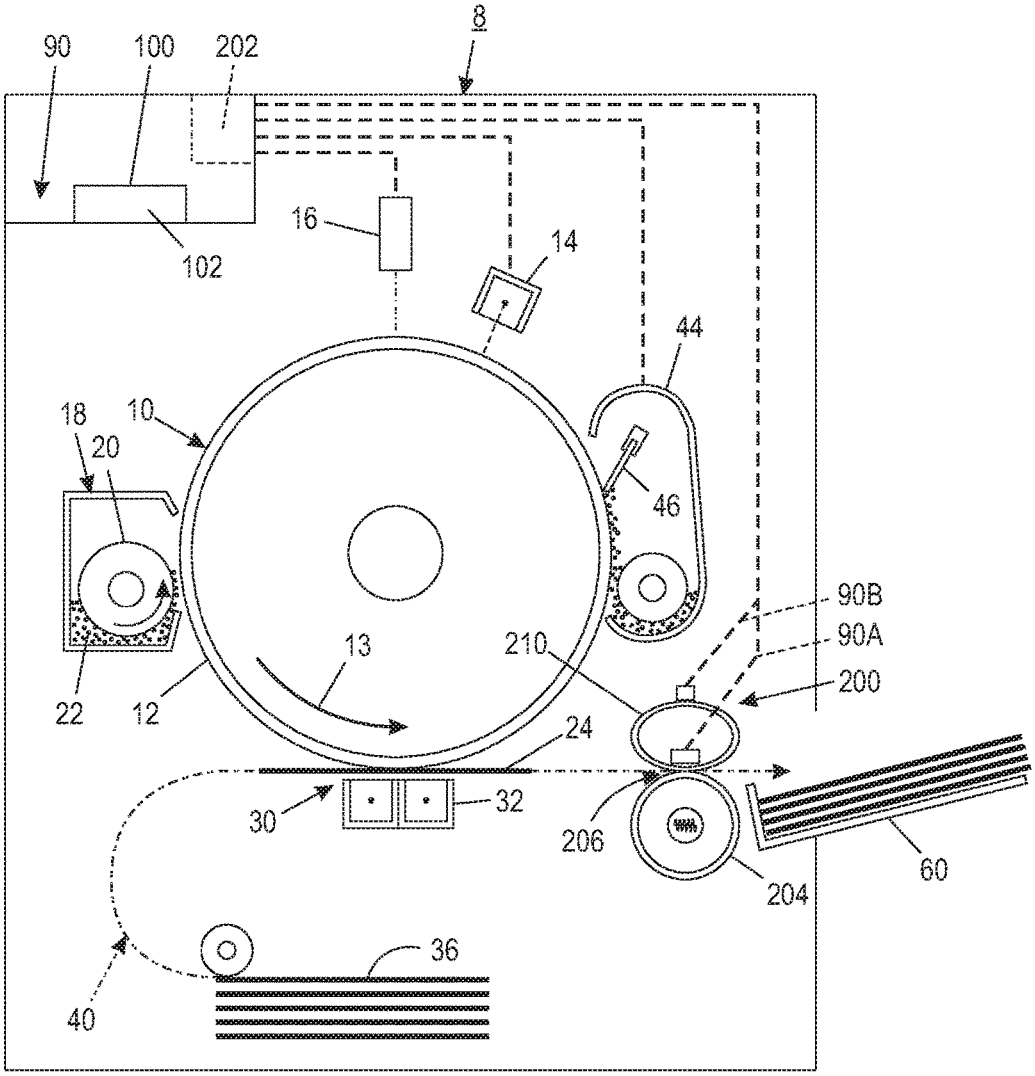

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
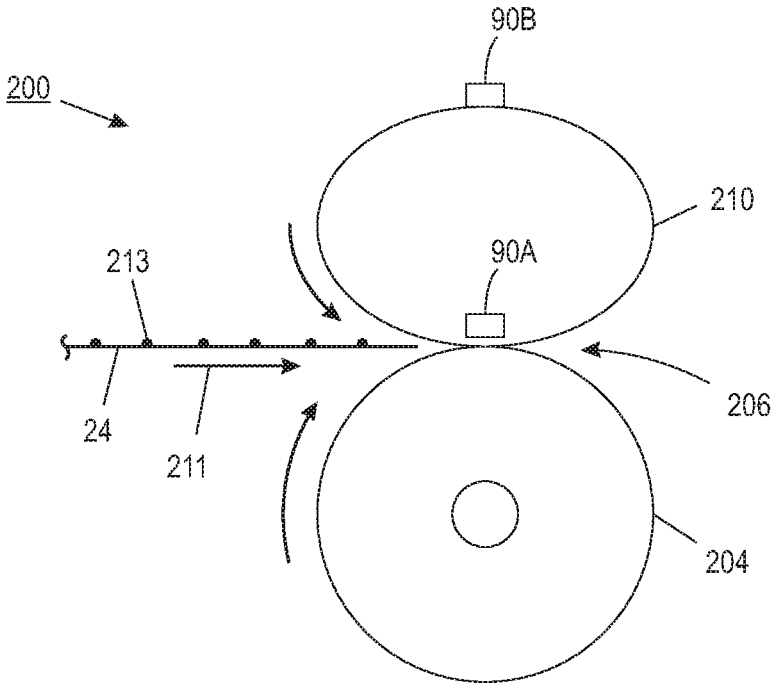
Figure 3:
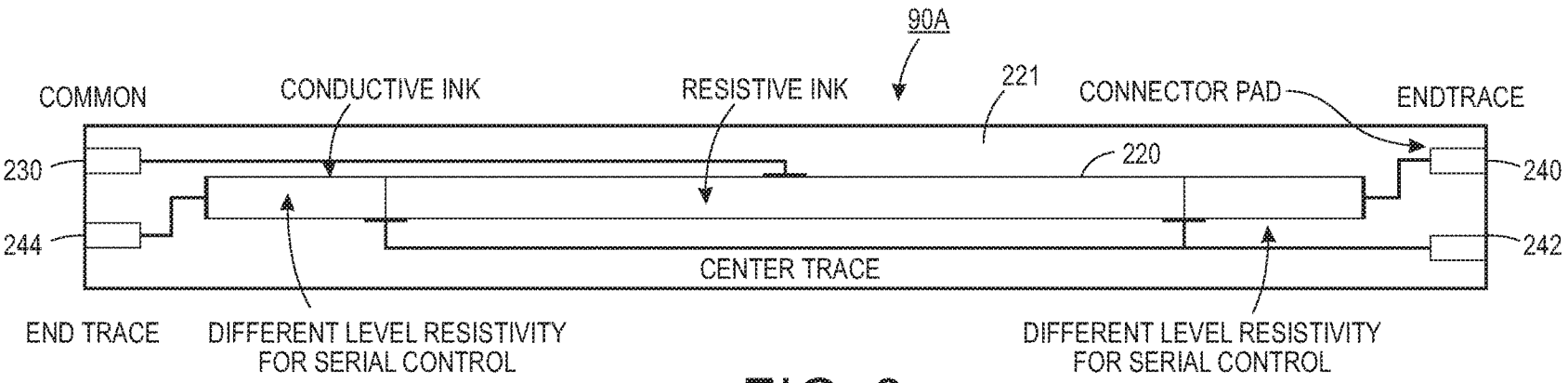
Figure 4:
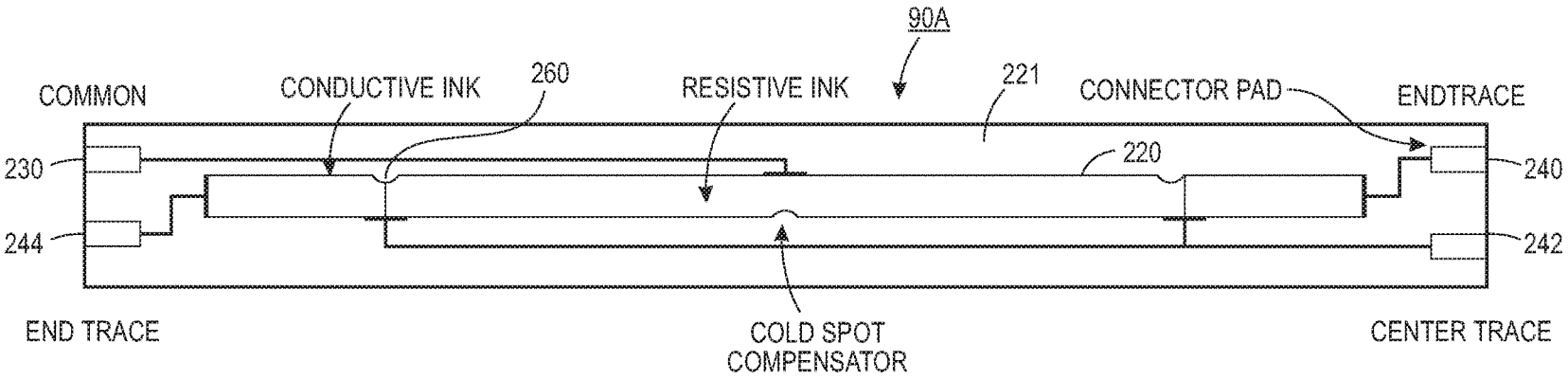

Several of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 1 is an elevational view showing relevant elements of an exemplary toner imaging electrostatographic machine including a first embodiment of the fusing apparatus of the present disclosure;

FIG. 2 is an enlarged schematic end view of the fusing apparatus of FIG. 1;

FIG. 3 is partial plan view of the heater portion of the first embodiment of the improved fuser of FIG. 2 that employs a single resistive trace with multiple taps for heating different media widths; and FIG. 4 is a partial plan view of the heater portion of a second embodiment of an improved fuser that employs a single resistive trace that mitigates cool zones.

Figure 5:
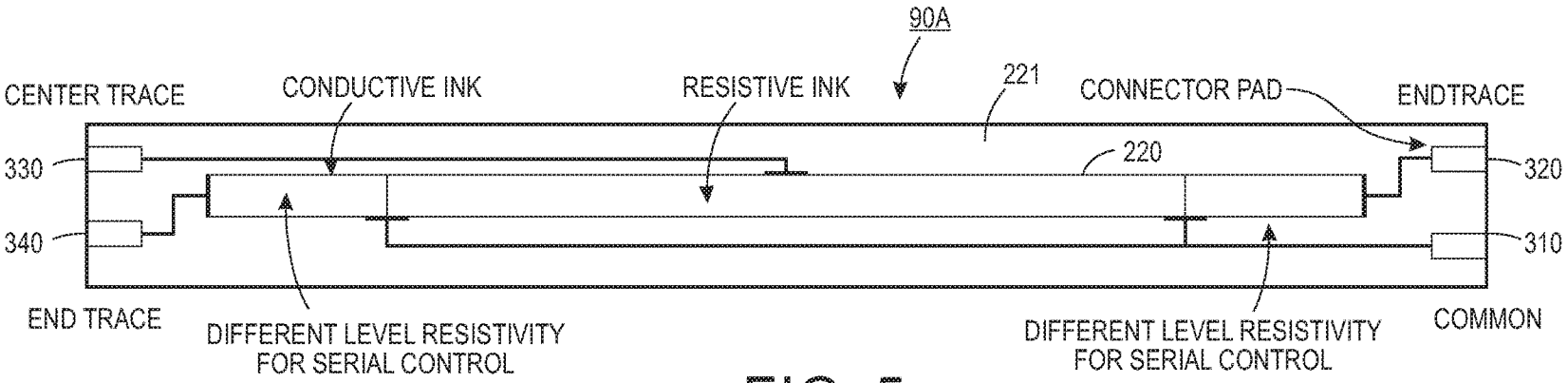
Figure 6:
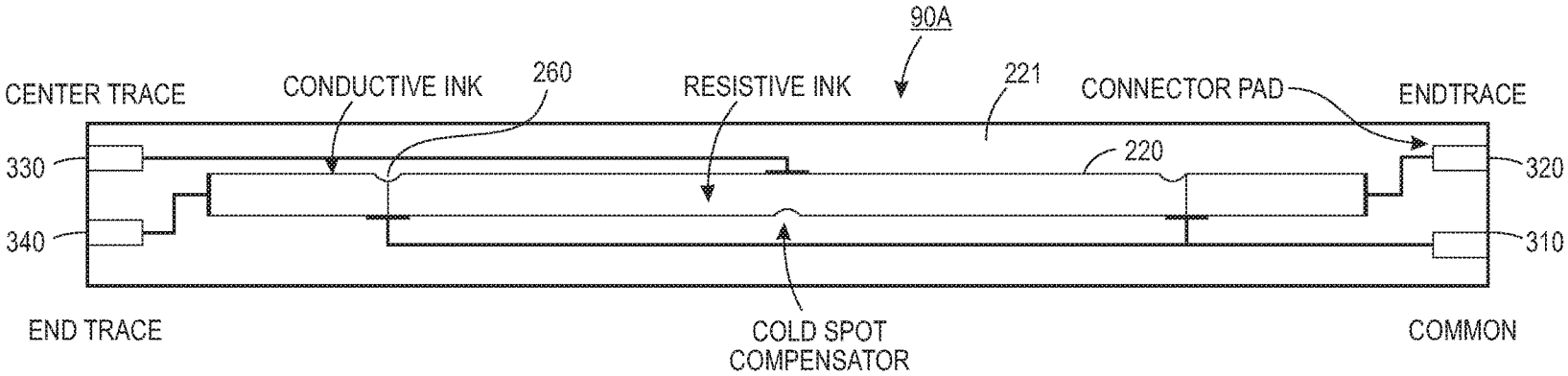

FIG. 5 is partial plan view of the heater portion of an alternative embodiment of the improved fuser of FIG. 2 that employs a single resistive trace with multiple taps for heating different media widths; and FIG. 6 is a partial plan view of the heater portion of another embodiment of an improved fuser that employs a single resistive trace that mitigates cool zones.

Referring now to FIG. 1, an electrostatographic or toner-imaging machine 8 is shown. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that, for example, includes a developer roll 20 for applying a supply of charged toner particles 22 to such latent image. The developer roll 20 may be of any of various designs, such as, a magnetic brush roll or donor roll, as is familiar in the art. The charged toner particles 22 adhere to appropriately charged areas of the latent image. The surface of the photoreceptor 10 then moves, as shown by the arrow 13, to a transfer zone generally indicated as 30. Simultaneously, a print sheet 24 on which a desired image is to be printed is drawn from sheet supply stack 36 and conveyed along sheet path 40 to the transfer zone 30.

At the transfer zone 30, the print sheet 24 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, including the fusing station having a high precision-heating and fusing apparatus 200 of the present disclosure, and then to an output tray 60. Following such transfer of a toner image from the surface 12 to the print sheet 24, any residual toner particles remaining on the surface 12 are removed by a toner image baring surface cleaning apparatus 44 including a cleaning blade 46, for example.

As further shown, the reproduction machine 8 includes a controller or electronic control subsystem (ESS), indicated generally by reference numeral 90 which is preferably a programmable, self-contained, dedicated mini-computer having a central processor unit (CPU), electronic storage 102, and a display or user interface (UI) 100. At UI 100, a user can select one of the pluralities of different predefined sized sheets to be printed onto. The conventional ESS 90, with the help of sensors, a look-up table 202 and connections, can read, capture, prepare and process image data such as pixel counts of toner images being produced and fused. As such, it is the main control system for components and other subsystems of machine 8 including the fusing apparatus 200 of the present disclosure.

Referring now to FIG. 2, the fusing apparatus 200 of the present disclosure is illustrated in detail and is suitable for uniform and quality heating of unfused toner images 213 in the electrostatographic reproducing machine 8. As illustrated, fusing apparatus 200 includes a rotatable pressure member 204 that is mounted forming a fusing nip 206 with a highly conductive ceramic fuser roll member 210. Heater 90A is positioned in contact with the inner diameter of fuser roll belt 210. Heater 90B is optional as required by design configuration. A copy sheet 24 carrying an unfused toner image 213 thereon can thus be fed in the direction of arrow 211 through the fusing nip 206 for high quality fusing.

In FIGS. 3 and 4, improved heating element design configurations are disclosed in accordance with the present disclosure that are especially adapted for surface under rapid fusing (SURF) in a center registered office machine. These configurations use a single resistive heating trace with multiple taps for heating different media widths. They are unique in that a tap is placed at the center of the heating trace which can serve as a dedicated common when firing the different heating zones. In the configurations as shown in FIGS. 3 and 4, end trace high sides may be tied together within the fuser harness to reduce the number of pins needed in the fuser drawer connector.

Turning now to FIG. 3 in particular, heater 90A is shown that includes a single resistive element or trace 220. Resistive trace 220 is mounted on a ceramic substrate or other suitable structure 221 that can accommodate a heating element. Resistive trace 220 is printed resistance. The printed trace is made from resistive ink that is deposited on a print layout on the ceramic substrate. A variety of electrical elements can be printed with electrically functional inks; such elements can be fashioned to exhibit certain dielectric, resistive, conductive, and semi-conductive properties. The trace is manufactured with resistive ink and the conductive paths with conductive ink. As a general rule, printed resistance can be defined as follows:

$$R=\Omega(L/A)$$

where,

R=resistance;

Ω=bulk resistivity of the ink or resistance per unit volume;

L=length of resistor ink; and

A=cross sectional area of the resistor ink.

The cross-sectional area of the resistor ink in turn equals the product of the print thickness (T) and the width (W) of the resistor ink. Substituting these parameters yields the following formula for the resistance of a printed resistor:

$$R=\Omega(L/TW)$$

Thus, the resistance of a printed resistor is a function of the bulk resistivity of the ink used to print the resistor, the length (L) of the resistor ink, the thickness (T) of the printed resistor ink and the width (W) of the printed resistor ink. Resistors having different resistances can thus be formulated by varying any of these parameters (L, T, or W).

The heater configuration 90A shown in FIG. 3 uses a single resistive heating trace with multiple taps for heating different media widths. Unlike prior single resistive trace heating elements, the disclosed single resistive trace heating element includes a tap positioned at the center of the heating trace which serves as a dedicated common when firing the different heating zones. A suitable conventional electrical circuit for the heater of FIG. 3 will include having three segments with each connected electrically through a resistor to a common contact pad 230 and a second contact pad 240 to a voltage driver. This configuration includes a single resistive element consisting of a resistive trace 220 having conductive paths on both ends and one side in the process direction. Opposite ends of resistive trace 220 can have different levels of resistivity for serial control. A single continuous conductive trace referred to as the common is connected to the center of resistive trace 220 and separate conductive traces are connected to the ends of resistive trace 220. On the ends and center portions of resistive trace 220 are three separate conductive traces to allow heating for different paper widths corresponding to A3 and A4 sheets and the like. By placing a common tap at the center of the single heating trace 220, a dedicated common line that does not have to be switched around when firing different heating zones is provided and this allows for the benefits of a single trace design well. It should be understood that heater 90A is conventionally heated by applying voltage at connector pads 240, 242 and 244 along the conductive traces. Connector pad 230 is maintained at a common voltage, such as, 0 volts.

In FIG. 4, an alternative embodiment of heater 90A in FIG. 3 is shown that in all respects is the same as the heater in FIG. 3, and in addition, provides a single trace design which includes reductions 260 in the heating traces near the taps and center of resistive trace 220 to serve as cold spot compensators and thereby mitigate the cool zones created by the taps. As shown, end trace high sides (240, 244) may be tied together within the fuser harness or within the resistive element in a different vertical layer so as to reduce or limit the number of pins needed in the fuser drawer connector.

An alternative heater configuration 90A is shown in FIG. 5 that is the same as FIG. 3 except that positions for the common line and center trace are switched. That is, FIG. 5 includes a common contact pad 310 and a second contact pad 320 connected to a voltage driver. This configuration includes a single resistive element consisting of a resistive trace 220 having conductive paths on both ends and one side in the process direction. Opposite ends of resistive trace 220 can have different levels of resistivity for serial control. Common contact pad 310 is connected to the center of resistive trace 220 and separate conductive traces are connected to the ends of resistive trace 220. On the ends and center portions of resistive trace 220 are three separate conductive traces to allow heating for different paper widths corresponding to A3 and A4 sheets and the like. Heater 90A is conventionally heated by applying voltage at connector pads 320, 330 and 340 along the conductive traces. Connector pad 310 is maintained at a common voltage, such as, 0 volts.

In FIG. 6, another alternative embodiment of heater 90A is shown that is the same as FIG. 4 except that positions for the common line and center trace are switched. The heater arrangement of FIG. 6 provides a single trace design which includes reductions 260 in the heating traces near the taps and center of resistive trace 220 to serve as cold spot compensators and thereby mitigate the cool zones created by the taps. It should be understood that end trace high sides (320, 330) may be tied together within the fuser harness or within the resistive element in a different vertical layer in order to reduce or limit the number of pins needed in the fuser drawer connector.

In recapitulation, the embodiments of the present disclosure address a problem of center registered solid heaters either requiring multiple heating traces or a relay to switch between multiple taps on one trace. Multiple heating traces have been shown to negatively affect heat transfer performance and thus extendibility. Single heating trace configurations with multiple tap designs require an extra drawer connector pin as compared to multiple trace designs. Also, cold spots on a segmented ceramic fuser heater at the point of contact between a resistive trace and a conductor trace is a problem. An electrical contact to heater segments is needed within the image area and prior heater designs exhibit a cold spot at that point due to cooling. The present disclosure solves these problem by providing a single resistive heating trace with multiple taps for heating different media widths and places a tap right at the center of the heating trace. This provides a single line that can then serve as a dedicated common when firing the different heating zones. In addition, reductions are placed in the heating trace near the taps to mitigate the cool zones created by the taps. As a result, a single dedicated common line is accomplished along with one less pin drawer connector than prior single trace designs.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print an image onto a copy sheet, comprising:

an imaging apparatus for processing and recording an image onto said copy sheet;

an image development apparatus for developing the image;

a transfer device for transferring the image onto said copy sheet; and a fuser for fusing the image onto said copy sheet, said fuser including a fuser roll and a pressure roll that forms a nip therebetween through which said copy sheet is conveyed in order to permanently fuse the image onto said copy sheet, and wherein said fuser roll includes a heater comprising a single resistive trace with multiple taps for heating different media widths, and wherein one of said multiple taps is placed approximately at the center of said single resistive trace; and wherein said one of said multiple taps approximately at the center of said single resistive trace is a common trace.

2. The xerographic device of claim 1, wherein said multiple taps comprise multiple conductive traces.

3. The xerographic device of claim 2, wherein said multiple conductive traces includes end traces at opposite ends of said single resistive trace.

4. The xerographic device of claim 3, wherein said single resistive trace is configured to include cold spot compensators.

5. The xerographic device of claim 4, cold spot compensators include reduced areas within said single resistive trace.

6. The xerographic device of claim 5, wherein said reduced areas are positioned on said single resistive trace opposite taps into said single resistive trace.

7. An electrophotographic printing machine including a fuser, said fuser comprising:

a pressure roll; and a fuser roll that forms a nip therebetween through which sheets are conveyed in order to permanently fuse an image onto said sheets, and wherein said fuser roll includes a heater having a single resistive trace with multiple taps for heating different sheet widths, and wherein said multiple taps include a tap placed at about the center of said single resistive trace; and wherein said tap at about said center of said single resistive trace serves as a dedicated common line when firing different heating zones of said single resistive trace.

8. The electrophotographic printing machine of claim 7, wherein said tap at said center of said single resistive trace is positioned at a downstream side of said single resistive trace.

9. The electrophotographic printing machine of claim 7, including a cold spot compensator positioned within said single resistive trace opposite said tap at said center of said single resistive trace.

10. The electrophotographic printing machine of claim 9, wherein said cold spot compensator is a recess in said single resistive trace.

11. The electrophotographic printing machine of claim 10, wherein said single resistive trace includes one recess on one side of said single resistive trace and one recess on an opposite side of said single resistive trace.

12. The electrophotographic printing machine of claim 7, wherein said single resistive trace includes two recesses on one side thereof and only one recess into another side thereof for cold spot compensation.

13. A printing machine adapted to print an image on a copy sheet, comprising:

an imaging apparatus for processing and recording an image onto said copy sheets;

an image development apparatus for developing the image;

a transfer device for transferring the image onto said copy sheet; and a fuser for fusing the image onto said copy sheet, said fuser including a fuser roll and a pressure roll that forms a nip therebetween through which a copy sheet is conveyed in order to permanently fuse said image onto said copy sheet, and wherein said fuser roll includes a heater having a single resistive trace and multiple conductive traces with taps into said single resistive trace, and wherein said single resistive trace includes a common trace tap at a center portion thereof.

14. The printing machine of claim 13, wherein said tap at said center portion of said single resistive trace is used as a dedicated common line when firing different heating zones of said single resistive trace.

15. The printing machine of claim 13, wherein said single resistive trace includes reductions therein opposite said taps in order to mitigate cool zones created by said taps.

16. The printing machine of claim 13, wherein said single resistive trace includes resistivity levels at ends thereof that are different from a center portion thereof for serial control.

17. The printing machine of claim 16, wherein said single resistive trace and said multiple conductive traces are mounted on a ceramic substrate.

18. The printing machine of claim 13, wherein said common trace tap is at 0 volts.

* * * * *